US007634840B2

(12) United States Patent
Kobayashi et al.

(10) Patent No.: US 7,634,840 B2
(45) Date of Patent: Dec. 22, 2009

(54) METHOD FOR PRODUCING PITCH-BASED CARBON FIBER SILVER AND SPUN YARN

(75) Inventors: Tatsuo Kobayashi, Fukushima-Ken (JP); Naohiro Sonobe, Fukushima-Ken (JP)

(73) Assignee: Kureha Corporation, Tokyo (JP)

( * ) Notice: Subject to any disclaimer, the term of this patent is extended or adjusted under 35 U.S.C. 154(b) by 595 days.

(21) Appl. No.: 10/582,866

(22) PCT Filed: Dec. 14, 2004

(86) PCT No.: PCT/JP2004/018983

§ 371 (c)(1),
(2), (4) Date: Jun. 14, 2006

(87) PCT Pub. No.: WO2005/059213

PCT Pub. Date: Jun. 30, 2005

(65) Prior Publication Data

US 2007/0145620 A1 Jun. 28, 2007

(30) Foreign Application Priority Data

Dec. 17, 2003 (JP) ..... 2003-419938

(51) Int. Cl.
*D01G 27/00* (2006.01)

(52) U.S. Cl. ..... 19/150

(58) Field of Classification Search ..... 19/115 R, 19/150

See application file for complete search history.

(56) References Cited

U.S. PATENT DOCUMENTS

| | | | | |
|---|---|---|---|---|
| 5,375,298 | A | 12/1994 | Nakamura et al. | |
| 5,430,911 | A | 7/1995 | Nakamura et al. | |
| 6,219,885 | B1 * | 4/2001 | Faas et al. | 19/98 |

FOREIGN PATENT DOCUMENTS

| | | | |
|---|---|---|---|
| JP | 53-14838 | | 2/1978 |
| JP | 2-8051 | | 1/1990 |
| JP | 5-59624 | | 3/1993 |
| JP | 6-57542 | | 3/1994 |
| JP | 08158170 A | * | 6/1996 |

* cited by examiner

*Primary Examiner*—Shaun R Hurley
(74) *Attorney, Agent, or Firm*—Wenderoth, Lind & Ponack, L.L.P.

(57) ABSTRACT

A pitch-based carbon fiber sliver providing a high-strength carbon fiber spun yarn is efficiently produced by providing a pitch-based carbon fiber mat comprising a mass of piled-up pitch-based carbon fibers of which fiber extension directions are aligned preferentially in one direction; and directly subjecting the carbon fiber mat to drawing and carding by means of a carding machine while moving the mat in said one preferential alignment direction. The thus-obtained carbon fiber sliver is drawn and twisted to produce a pitch-based carbon fiber spun yarn containing at least 3 wt. % of fibers having a fiber length of at least 150 mm, a number of primary twist of 50-400 turns/m and a tensile strength of at least 0.10 N/tex.

9 Claims, 4 Drawing Sheets

CARDING MACHINE

METHOD FOR PRODUCING PITCH-BASED CARBON FIBER SILVER AND SPUN YARN

TECHNICAL FIELD

The present invention relates a process (or method) for producing a carbon fiber sliver from an (isotropic) pitch-based carbon fiber and a process for producing a carbon fiber spun yarn by drawing and twisting the carbon fiber sliver.

BACKGROUND ART

A term "sliver" is generally understood to mean a tow-form mass of fibers which is composed of discrete unit fibers that are aligned in parallel to form a bundle without causing unnecessary entanglement and has a length that can be regarded as infinitely long compared with those of the unit fibers. (A part of such a concept is found in an upper left column on page 2 of Patent document 3 shown below.) Carbon fiber sliver is useful as a half product for various carbon fiber products. More specifically, a carbon fiber sliver may be processed by spinning to provide a spun yarn, and such a spun yarn may be woven to provide a carbon fiber textile (cloth). Further, a carbon fiber sliver may be milled or pulverized to provide a milled product or cut to a length of 100 mm or below to provide chops; and chops may be transformed into a paper through a wet process or into a mat through a dry process, or cut, disentangled, laid in layers and needle-punched to provide a felt, respectively. These carbon fiber products are widely used as products, such as heat-resistant materials, electroconductive materials, reinforcing materials and thermally insulating materials by utilizing the properties thereof, such as heat resistance, electroconductivity and strength.

As for processes for producing carbon fiber slivers, Patent document 1 shown below discloses a process for producing a carbon fiber spun yarn wherein a carbon fiber precursor sliver having fiber lengths of at least 25 mm, preferably 50-75 mm is spun, as it is or after it is made preliminarily fire-resistant according to necessity, and heated above its carbonizing temperature. However, the lengths of fibers in the sliver used in the process are short, and the resultant strength cannot be regarded as sufficient. Patent document 2 shown below discloses a process wherein a pitch-based carbon fiber is mixed with a natural fiber and/or a synthetic fiber and disentangled to provide mixed fibers which are carded into a fleece and then into a sliver, and the sliver is drawn and twisted simultaneously to provide a spun yarn. However, this process requires a troublesome step of further heat-treating the natural fiber and/or synthetic fiber for conversion into carbon fiber and also involves a problem that physical property changes caused by, e.g. shrinkage due to carbonization, have to be predicted in advance. Further, it is impossible to obtain a spun yarn of sufficient tensile strength because of shortness of the used fibers.

Patent document 3 shown below discloses a process for producing a carbon fiber sliver wherein various forms of pitch-based carbon fiber mass obtained after spinning and calcination are mixed with 10-40 wt. % of carbon precursor fibers other than pitch-based one to provide a mixture fleece, and the mixture fleece is subjected to drawing and doubling after carding or directly without carding, followed by carbonization of the resultant doubled fiber to provide a sliver principally comprising pitch-based carbon fiber. In the production process, the mixing of the pitch-based carbon fiber and the carbon precursor fiber may be performed by using a generally well-adopted air blowing disentanglement and fleece-forming method but sufficient disentanglement and disintegration of starting fibers are required in order to accomplish a uniform mixing in the air blowing disentanglement step, so that the process involves a problem of requiring preliminary cutting of the pitch-based carbon fiber and the carbon precursor fiber into short fibers of 5-30 mm. Further, it is presumed impossible to obtain a strong spun yarn because of the short fiber length.

Patent document 1: JP-A 53-81735,
Patent document 2: JP-A 8-158170,
Patent document 3: JP-A 1-148813,
Patent document 4: JP-A 62-33823, and
Patent document 5: JP-A 50-6822.

DISCLOSURE OF INVENTION

An object of the present invention is to provide an efficient process for producing a pitch-based carbon fiber sliver capable of providing a high-strength spun yarn.

Another object of the present invention is to provide an efficient process for producing a high-strength spun yarn from such a pitch-based carbon fiber sliver.

As a result of earnest study, the present inventors have found processes capable of producing pitch-based carbon fiber mats comprising a mass of piled-up pitch-based carbon fibers of which the fiber extension directions are aligned and caused to extend preferentially in one direction (as disclosed in Patent documents 4 and 5 shown above) among the processes for producing pitch-based carbon fibers already developed by the present applicant, and have also found it possible to effectively obtain a carbon fiber sliver capable of providing a high-strength spun yarn by directly subjecting a pitch-based carbon fiber mat having such a morphological characteristic to a carding process.

Thus, the process for producing a pitch-based carbon fiber sliver according to the present invention, comprises: providing a pitch-based carbon fiber mat comprising a mass of piled-up pitch-based carbon fibers of which fiber extension directions are aligned preferentially in one direction; and directly subjecting the carbon fiber mat to drawing and carding by means of a carding machine while moving the mat in said one preferential alignment direction.

The present invention also provides a process for producing a pitch-based carbon fiber spun yarn, comprising: drawing and twisting a pitch-based carbon fiber sliver obtained through the above-mentioned process to produce a spun yarn which contains at least 3 wt. % of carbon fiber having a fiber length of at least 150 mm, has a number of primary twist of 50-400 turns/m and has a tensile strength of at least 0.10 N/tex.

BEST MODE FOR PRACTICING THE INVENTION

Figure 1:
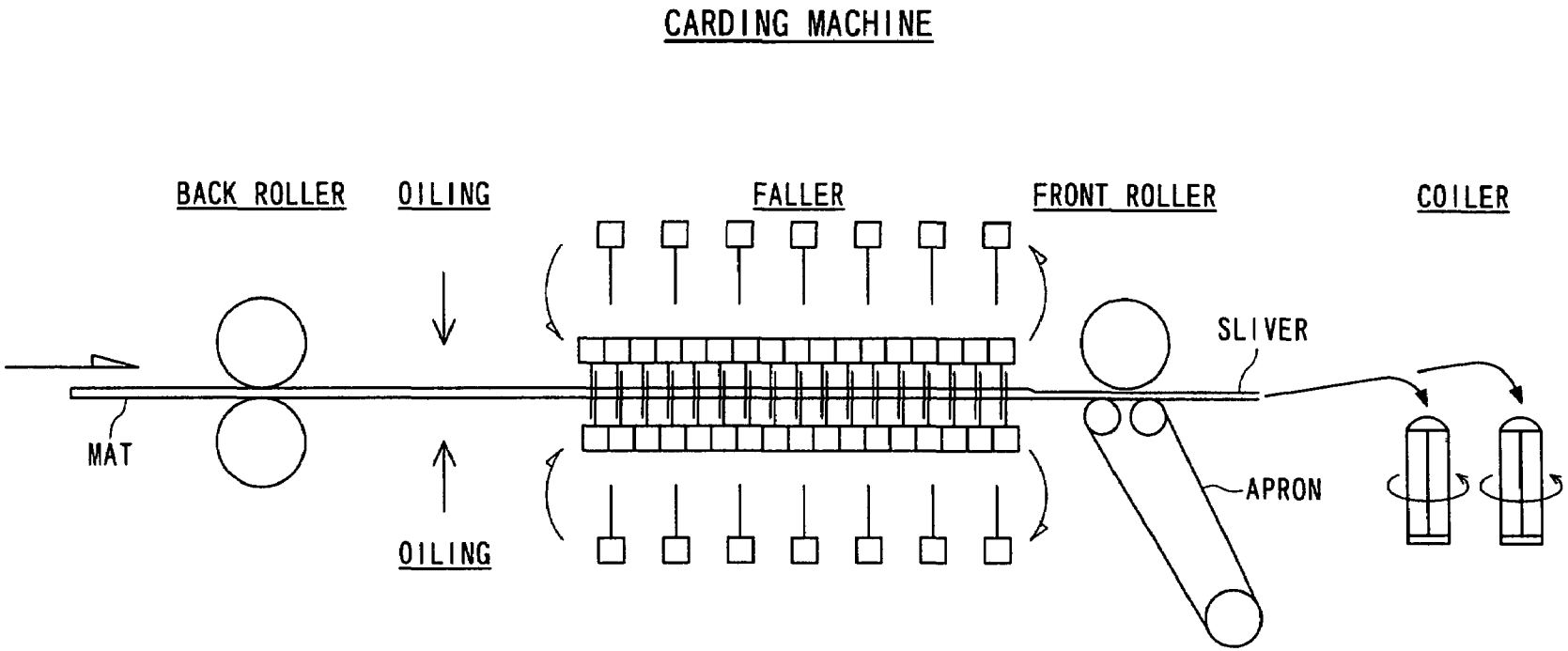
FIG. 1 is a schematic arrangement view of a carding machine (large-width guile) suitable for use in the process of the invention.

The process for producing a pitch-based carbon fiber sliver according to the present invention uses, as a starting material, a pitch-based carbon fiber mat comprising a mass of piled-up pitch-based carbon fibers having a fiber length substantially larger than that of carbon fibers in the product spun yarn and having their fiber extension directions aligned preferentially in one direction. Such a starting carbon fiber mat may be formed by "a process for producing a carbon fiber mat, comprising: melt-spinning a fiber-forming pitch (having a carbon content of 89-97 wt. % and an average molecular weight of 400-5000) by means of a centrifugal spinning machine of the type having a horizontal axis of rotation; stretching the thus-spun fibers; cutting the thus-stretched fibers by at least one cutter disposed on a stretching plate of the centrifugal spinning machine; piling the cut fibers on a horizontal belt conveyer which is positioned below the centrifugal stretching machine and moves in a direction perpendicular to the rotation axis of the centrifugal spinning machine while traversing (reciprocally moving) in a direction parallel to the rotation axis of the centrifugal spinning machine, thereby to form a pitch fiber mat; and then infusibilizing and calcining the pitch fiber mat" (Patent document 4 shown above), or "a process for producing tow carbon fibers, comprising: melt-spinning a fiber-forming pitch; drawing and spinning resultant pitch filaments to deposit on a conveyer belt while traversing (reciprocally moving) the pitch fiber at a speed substantially larger than the running speed of the pitch fiber after drawing and thinning in a direction substantially parallel to the moving direction of the conveyer belt to deposit the fibers in a direction aligned with the moving direction of the conveyer belt; and then infusibilizing and calcining the pitch fibers" (Patent document 5 shown above).

According to the former process (of Patent document 4), the width of the mat is determined by the amplitude of the reciprocal movement of the horizontal belt conveyer, and the fiber length distribution is determined by the rotation speed of the bowl, the timing of cutting the spun pitch fibers by the cutter (corresponding to a fiber length of at least 1.5 m) and the frequency of cutting of the spun pitch fiber due to the wind acting during the centrifugal spinning. Generally, 30-70 wt. % is occupied by carbon fibers having fiber lengths of 250 mm or longer in most cases. According to the latter process (of Patent document 5), the fiber length distribution in a single direction is determined by the timing of switching reciprocal movement directions of the drawn and thinned pitch fiber deposited on the conveyer belt and the cutting of the thinned pitch fiber due to the wind. The single-direction fiber length is 30-200 cm for example. The switching of the reciprocal moving directions of the thinned pitch fibers is performed by alternately switching the directions of high-speed air stream blown against sides of the pitch filaments ejected out of the spinning nozzle and fed by sucking by an air sucker (a take-up device using a high-speed air stream). In either case, a mat composed of a mass of carbon fibers piled while preferentially extending in the moving direction of the conveyer belt. The mat of the former process is composed a mass of discrete fibers extending in one direction, and the mat of the latter process can contain continuous fiber having foldings at both ends. Anyway, either mat is in a state that can be directly applied to drawing and carding (or combing) by a carding machine in a subsequent step.

Of the above-mentioned processes, the former process of using a pitch fiber obtained by melt-spinning by means of a centrifugal spinning machine having a horizontal rotation axis is preferred in view of the production efficiency.

Incidentally, the term "directly" in the phrase of "directly subjecting the carbon fiber mat to drawing and carding by means of a carding machine" means that steps, such as cutting, disentanglement and doubling, usually performed for obtaining a sliver from a carbon fiber mat, are omitted, and does not mean that even a simple pretreatment of the mat prior to the processing by a carding machine not causing an essential transformation of the carbon fiber per se is excluded.

The above-mentioned pitch used for providing the carbon fiber mat may be either isotropic or anisotropic. However, a carbon fiber obtained from anisotropic pitch is not sufficient in entanglement of the fibers due to a high elastic modulus, and compared therewith, a carbon fiber obtained from isotropic pitch can provide a spun yarn of a high tensile strength due to sufficient entanglement of fibers because of a lower elastic modulus, so that isotropic pitch is preferred.

A mat-form pitch fiber piled-up on a conveyer belt (preferably one having air penetrability for allowing air-sucking therethrough from a side opposite to the face loaded with the piled pitch fiber) is then infusibilized and calcined according to ordinary methods into a carbon fiber.

More specifically, for example, the infusibilization is effected by heating at 100-400° C. in an atmosphere of air containing an oxidizing gas, such as $NO_2$, $SO_2$ or ozone, and the calcinations is performed by heating at 500-2000° C. in a non-oxidizing atmosphere.

The thus-formed pitch-based carbon fiber mat may have dimensions (optionally after adjustment of thickness and width) including, e.g., a single fiber diameter of 5-20 μm, an areal weight of 0.1-0.6 kg/m$^2$, a thickness of 5-30 mm, a width of 100-850 mm, and a length of 100 m or longer. The mat can be rolled up, as desired, to be stored in preparation for a subsequent processing by a carding machine.

The carbon fiber mat formed on a horizontal belt conveyer in the above-described manner may be subjected to slight adjustment of its thickness and width, as desired, and subjected to a processing by a carding machine.

FIG. 1 is a side view with respect to a processing direction of a carding machine (large-width guile) which has been redesigned into a larger width for treatment of a mat-form carbon fiber and, as a basic organization, includes an oil-spraying supply device and a faller including a large number of pairs of planted metal needles disposed above and below the carbon fiber mat between a pair of a back roller and a front roller arranged in the moving direction of the carbon fiber mat. A carbon fiber mat supplied by a horizontal belt conveyer (not shown) from a leftward of the drawing is sent from a back roller to a front roller, between which the mat is supplied by spraying with, e.g. ca. 1.8-2.0 wt. % of an oil for facilitating the carding and subjected to carding (combing) by falling and insertion at appropriate timing of a large number of pairs of planted needles of a faller to be straightened and smoothened in its fiber direction. Simultaneously, the carbon fibers are drawn owing to a peripheral speed ratio between the front roller rotating at a larger peripheral speed than the back roller and the back roller.

It is preferred that at least one of the front roller pair has an elastic surface for obviating the severance of the fibers, and in the embodiment shown, the lower rollers are covered with an apron (an endless belt for providing an increased area of contact with the sliver) exhibiting a rubber elasticity at its surface.

Having been subjected to drawing and carding (combing) in the carding machine and having left the front roller thereof, the carbon fibers form a sliver having an improved alignment of the fiber extension directions and wound about one or more cylindrical coilers after being divided according to necessity.

Important factors required for direct application of the pitch-based carbon fiber mat to drawing and carding by means of a carding machine are an alignment and a fiber length of the carbon fibers in the carbon fiber mat. A better alignment of the carbon fibers is represented by a larger anisotropy as defined in terms of a ratio of electrical resistances measured in two mutually perpendicular directions taken in parallel with the mat surface. More specifically, it is represented by a ratio $\rho_L/\rho_W$ of at most 0.25 between a resistance ($\rho_L$) measured in a preferential extension direction of the piled carbon fibers in the carbon fiber mat and a resistance ($\rho_w$) measured in a direction perpendicular to the preferential extension direction. The ratio is preferably at most 0.1, further preferably 0.05 or below. If the $\rho_L/\rho_W$ ratio exceeds 0.25, there occur process difficulties, such as frequent fiber severance and drawing irregularity.

As for the length of the mat-forming carbon fibers, if the fiber length is shorter than the distance between the front roller and the back roller, the carbon fibers are drawn due to slippage between the individual fibers to be passed through the carding step with little occurrence of carbon fiber severance. However, if the carbon fiber length is too short, there arises a problem, such as a low strength of the resultant carbon fiber spun yarn obtained therefrom. On the other hand, in the case where the carbon fiber length is longer than the distance between the front and back rollers, a portion of the fibers are severed and another portion of the fibers can be passed between the rollers due to slippage between individual carbon fibers owing to a function of the oil, etc. However, if the content of such long carbon fibers is too large, there can arise process difficulties, such as winding of carbon fibers about the rollers, drawing irregularity due to slippage with the rollers, and stoppage of the machine due to insufficiency of the pulling force of the front roller for pulling the carbon fibers. Further, in order to obtain a high-strength spun yarn, a longer fiber length is preferred because it results in fewer connection points between fibers. Accordingly, a preferable fiber length is considered to be such that it is shorter than and closest to the distance between the front and back rollers. As a measure of such preferable fiber length distribution, it is preferred that the pitch-based carbon fiber mat contains at least 30 wt. % of carbon fibers having a fiber length of at least 100 mm and satisfies the following relations (1) and (2) with respect to $M_{100}$ (N/tex) representing a tensile strength for a test length of 100 mm and $M_{200}$ (N/tex) representing a tensile strength for a test length of 200 mm, respectively in the preferential extension directions of the piled carbon fibers.

$$1.7\times10^{-3}\leqq M_{100}\leqq 1.2\times10^{-2} \quad (1)$$

$$0.4\leqq(M_{200}/M_{100})\leqq 1 \quad (2)$$

It is further preferred that the following relations (3) and (4) are satisfied.

$$2.0\times10^{-3}\leqq M_{100}\leqq 1.2\times10^{-2} \quad (3)$$

$$0.4\leqq(M_{200}/M_{100})\leqq 1 \quad (4)$$

The fiber length distribution is determined based not on a single condition but on mutually influencing various conditions or factors, for example as described above, e.g. in the case of melt-spinning by means of a centrifugal spinning machine having a horizontal rotation axis, and optimum conditions may be selected as desired.

The process for producing a carbon fiber sliver according to the present invention comprises the above-mentioned step of drawing and carding a carbon fiber mat by means of a carding machine as a basic step. The resultant carbon fiber sliver may be subjected to a drawframe process (a process of doubling and drawing (or drafting) a plurality of slivers for obtaining a sliver of further improved fiber alignment and uniformity) by means of a drawframe having an organization roughly as shown in FIG. 2.

Figure 2:
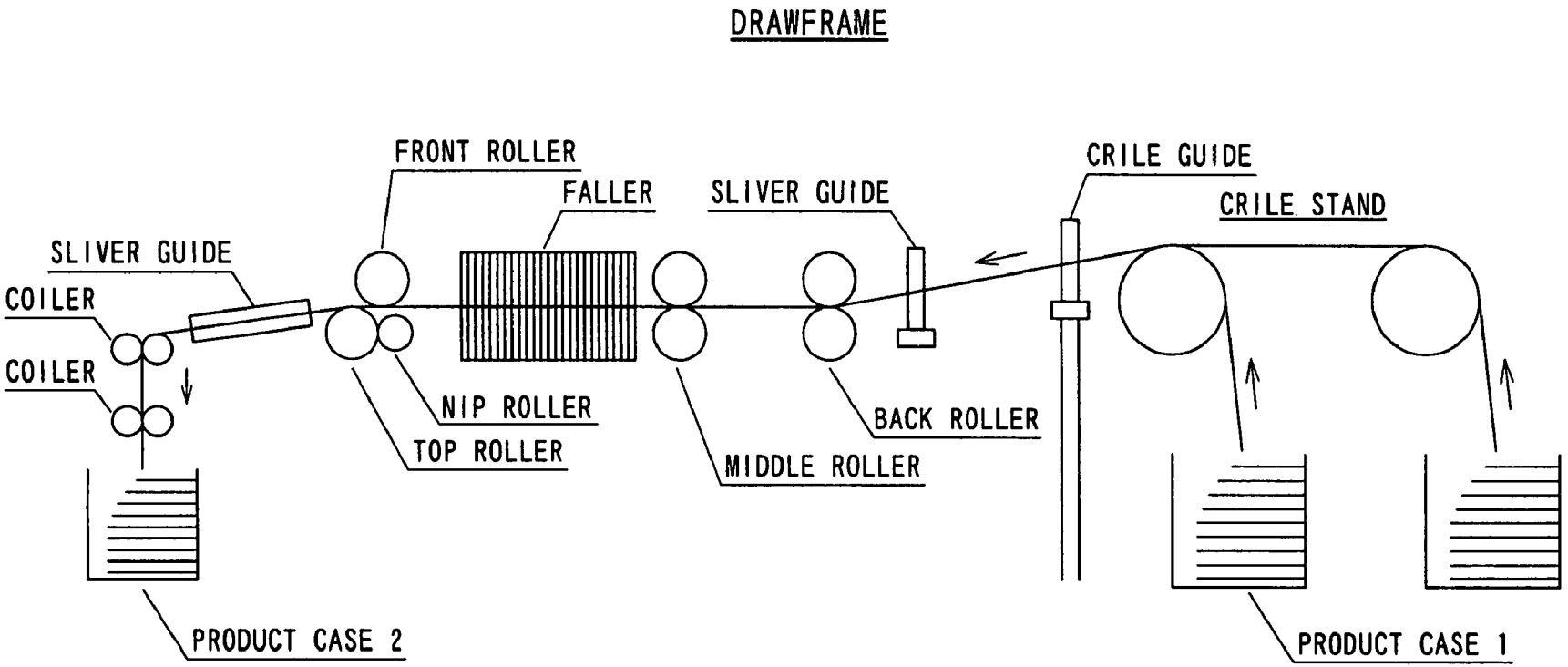
FIG. 2 is a schematic arrangement view of a drawframe suitable for use in the process of the invention.

For example, in the drawframe shown in FIG. 2, roughly wound slivers from the coilers in FIG. 1 are stored in product cases 1 from which two slivers are drawn out and are doubled while being sent leftwards along a crile stand and a sliver guide. Then, the slivers are drawn between a back roller and a front roller and additionally combed by a faller to form a sliver of improved alignment, which is then sent to product case 2.

The above-mentioned drawframe process is repeated plural times in order to provide a sliver having a thickness and a fiber alignment suitable for forming a spun yarn in a subsequent spinning step.

Figure 3:
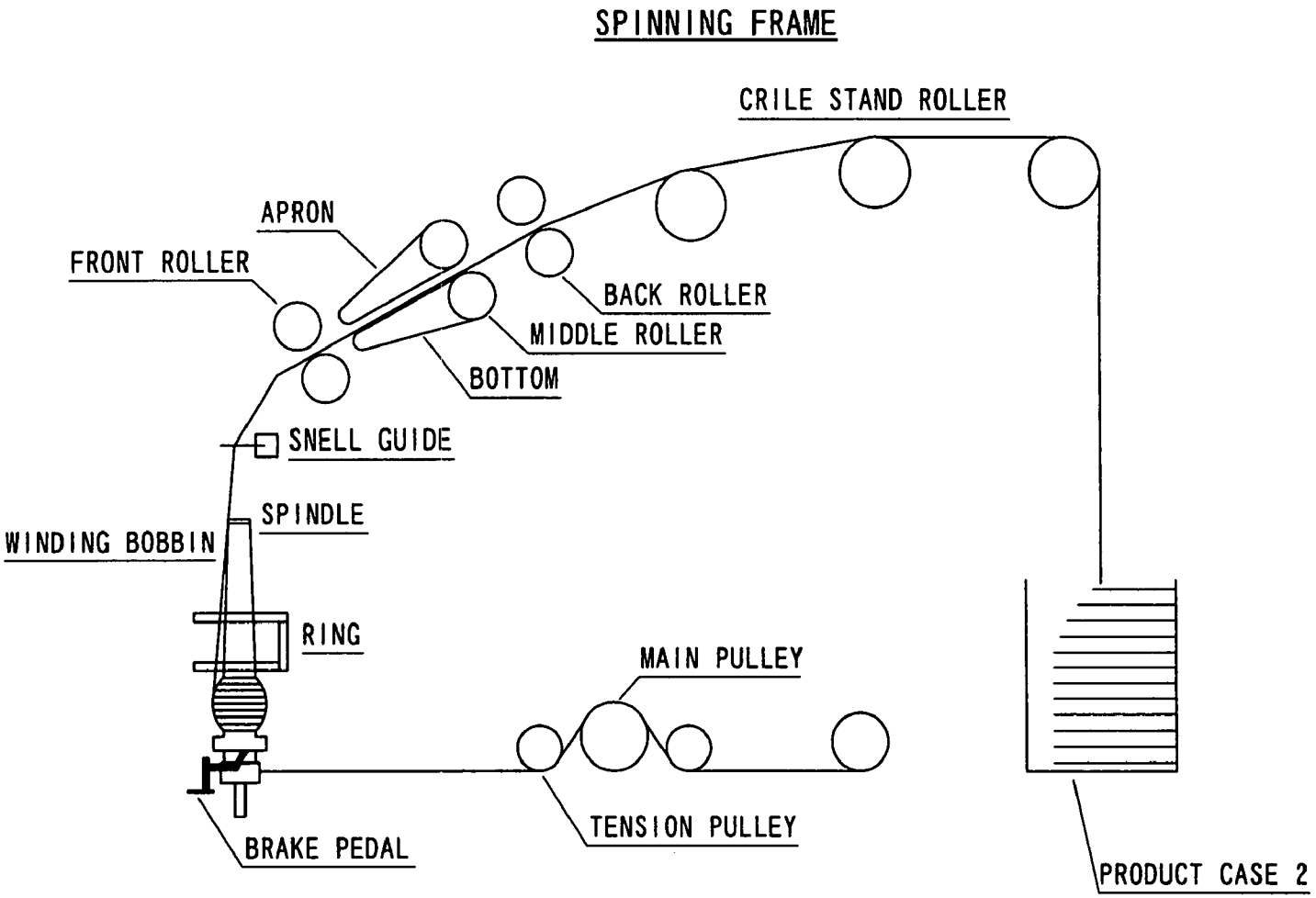
FIG. 3 is a schematic arrangement view of a spinning frame suitable for use in the process of the invention.

Then, the sliver having a thickness and a fiber alignment suitable for spinning stored in product case 2 is subjected to drawing and twisting (primary twist) by a spinning frame having an organization, e.g., as shown in FIG. 3 (a ring spinning frame), to form a single twist yarn, which is wound about a bobbin.

Figure 4:
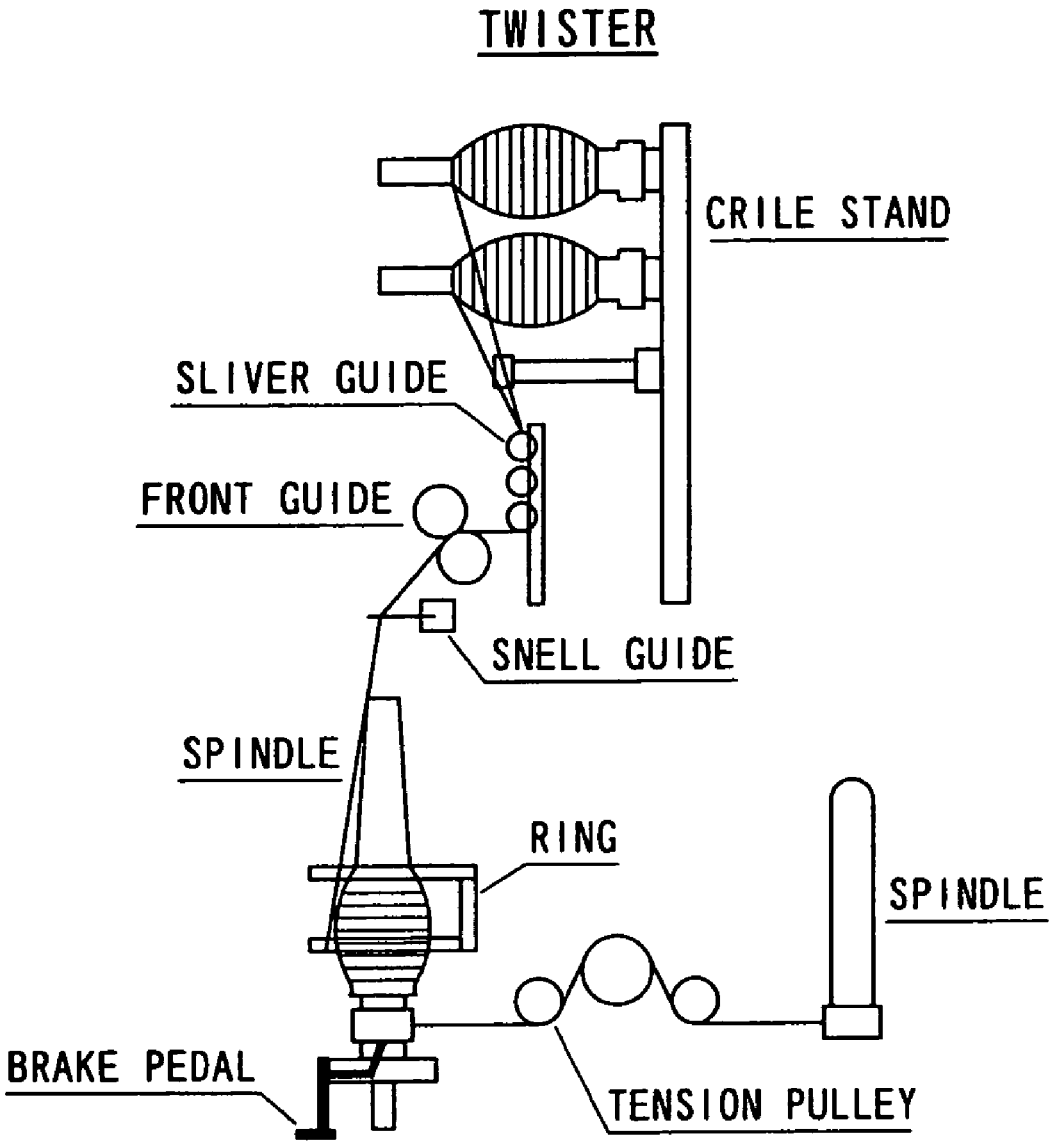
FIG. 4 is a schematic arrangement view of a twister suitable for use in the process of the invention.

With respect to the single twist yarn (single yarn) thus-obtained, a plurality (two in the figure) of them may be doubled and subjected to twisting (secondary twisting), as desired, to provide a double twist yarn (double yarn) by means of a twister having an organization, e.g., as shown in FIG. 4.

Also in the above-mentioned drawframe, spinning frame and twister, the surfaces of the rollers along which the fibers are passed in contact therewith should desirably have surfaces composed of elastic materials so as to suppress the severance of the fibers.

Accordingly, as a result of combing and drawing of the fibers in the above-mentioned drawframe, spinning frame and twister, the severance of fibers is inevitable as a whole, it is possible to regard that the frequency of severance of carbon fibers can be suppressed owing to the use of oil and elastic rollers in the process of the present invention.

The spun yarn obtained through the process of the present invention including the above-mentioned step may have representative values: a content of at least 3 wt. % of fibers having a fiber length of at least 150 mm, a thickness of 80-1500 tex, a number of primary twist of 50-400 turns/m, and a tensile strength of at least 0.10 N/tex, preferably 0.15 N/tex or higher. The carbon fiber diameter is on the order of 5-20 μm. Incidentally, the spun yarn strength and other properties described herein are based on values measured according to the following methods.

(1) Spun Yarn Strength

A tensile tester ("TENSILON UNIVERSAL TESTER, MODEL1310", made by K.K. Orientec) was used under the conditions of a length of spun yarn between chucks of 200 mm and a tensile speed of 200 mm/min. to measure a breaking tensile force, which was divided by a tex value of the sample yarn to obtain a spun yarn strength (N/tex). An average of 5 measured values was obtained.

(2) Tensile Strength of Pitch-Based Carbon Fiber Mat

From a sample carbon fiber mat, a test piece elongated in the preferential extension direction of piled carbon fibers of the mat was cut out so as to measure 200 mm in the preferential extension direction and 50 mm in a direction perpendicular to the preferential extension direction. Then, the tensile tester ("TENSILON UNIVERSAL TESTER, MODEL1310", made by K.K. Orientec) was used under the conditions of a length of the test piece between chucks of 100 mm and a tensile speed of 200 mm/min. to measure a breaking tensile force, which was divided by a tex value of the mat test piece to obtain a mat tensile strength $M_{100}$ (N/tex). Further, from the sample carbon fiber mat, another test piece elongated in the preferential extension direction of piled carbon fibers was cut out so as to measure 300 mm in the preferential extension direction and 50 mm in a direction perpendicular to the preferential extension direction. Then, the mat test piece was subjected to a tensile test under the conditions of a length of the test piece between chucks of 200 mm and a tensile speed of 200 mm/min. to obtain a breaking tensile force, which was divided by a tex value of the mat test piece to obtain a mat tensile strength $M_{200}$ (N/tex).

An average of 5 measured values was obtained in each case. The thicknesses of the test pieces were made identical in the range of 5-30 mm.

(3) Resistance Value ($\rho_L$) in the Preferential Extension Direction of Piled Carbon Fibers and Resistance Value ($\rho_w$) in a Direction Perpendicular to the Preferential Extension Direction of Piled Carbon Fibers, Respectively in a Carbon Fiber Mat:

From a sample carbon fiber mat, a test piece in the preferential extension direction of piled carbon fibers (measuring 220 mm in the preferential extension direction and 200 mm in a direction perpendicular to the preferential extension direction) and a test piece in a direction perpendicular to the preferential extension direction (measuring 220 mm in the direction perpendicular to the preferential extension direction and 200 mm in the preferential extension direction) were respectively cut out. The thicknesses of the test pieces were made identical in the range of 5-30 mm. The cut test pieces were respectively fixed between rigid plate electrodes equipped with copper terminals and, after being compressed at 4.9 MPa by a press, subjected to measurement of resistances in the carbon fiber preferential extension direction and in the direction perpendicular thereto by a resistance meter. The measurement was performed for 5 test pieces in each direction, and an average value was obtained in each direction.

EXAMPLES

Hereinbelow, the present invention will be described more specifically based on Examples.

Example 1

A. Preparation of Isotropic Pitch-Based Carbon Fiber Mat

A high-boiling-fraction after taking out olefins, such as ethylene and propylene, from a petroleum naphtha-cracking product (i.e., so called ethylene bottom oil) was heat-treated at 380° C. and distilled at 320° C. under a reduced pressure of 10 mm Hg-abs. to obtain a pitch having a carbon content of 94.5 wt. %, an average molecular weight of 620 and a softening point (by a KOKA-type flow tester) of 170° C.

The thus-obtained pitch was subjected to melt-spinning by using two centrifugal spinning machines of horizontal type (arranged in parallel with a conveyer) having a 200 mm-dia. bowl equipped with 420 nozzles each having a nozzle diameter of 0.7 mm at a feed rate of 10.8 kg/hr per machine (×2 machines), a rotation speed of 800 rpm and a stretching wind velocity of 100 m/sec. The thus melt-spun pitch fiber was successively subjected to cutting by a cutter, and then piled on a belt conveyer equipped with a 40 mesh-metal net belt reciprocally moved at 5 cycles/min. in a direction perpendicular to the progressing direction of the conveyer progressing at a speed of 1.51 m/min. to form a mat having an effective width of 700 mm, an areal weight of 0.32 kg/m$^2$, a thickness of 20 mm and an apparent density of 16 kg/m$^3$. The mat was a mass of short fibers (principally having lengths in a range of 100-1500 mm) but could be handled as continuous fibers because the fibers extended preferentially in the conveyer progressing direction.

The thus-prepared mat was subjected to infusibilization in an infusibilizing furnace, including no tray, of 10 m in total length while hanging the mat in a length of 1.5 m on bars disposed at a pitch of 300 mm and moved in circulation at a constant speed of 0.044 m/min. and blowing a circulating gas comprising 2% of $NO_2$ and the remainder of air at a velocity (as a vacant space velocity) of 0.5 m/sec in a direction perpendicular to the mat extension direction to elevate the temperature up to 100-250° C. in 3 hours while removing the reaction heat.

Then, the mat was hanged by its own weight in a vertical calcination furnace measuring 14.8 m as a total length (including a cooling zone) and 2 m in width and calcined by heating to 850° C. in 15 min., followed by cooling to 200° C., to be discharged out of the furnace.

The thus-obtained carbon fiber mat was free from melt-sticking fibers and exhibited unit fiber properties including a fiber diameter of 14.5 μm, a tensile strength of 800 MPa, a tensile elastic modulus of 35 GPa and an elongation of 2.3%, which could be regarded as good performances.

B. Carding, Drawframe Operation and Spinning

An isotropic pitch-based carbon fiber mat of 220 g/m having a width of 700 mm and a thickness of 20 mm obtained in the above-described manner was processed by a carding machine, i.e., coated with 2 wt. % (based on carbon fiber) of an oil for carbon fiber spinning ("RW-102", made by Takemoto Yushi K.K.) and drawn at a ratio of 10.0 times to straighten the fibers between a front roller and a back roller to obtain a sliver of 22 g/m. Then, two of the thus-obtained slivers were combined and drawn at a ratio of 3.9 times to provide a single sliver by a first drawframe. Further, two of the single slivers were combined and drawn at a ratio of 10.0 times to provide a single sliver by a second drawframe. Further, two of the slivers were combined at drawn at a ratio of 3.0 times to provide a single sliver by a third drawframe. Further, two of the slivers were combined and drawn at a ratio of 3.0 times to provide a single sliver of 1 g/m by a fourth drawframe. The sliver was drawn at 12.0 times and spun at a number of Z (left) twist of 300 turns/m to obtain a spun yarn of 83 tex by a spinning frame. Then, two of the spun yarns were combined and doubled by a number of S (right) twist of 180 turns/m to obtain a spun yarn of 166 tex by a twister. The properties of the thus-obtained spun yarn are shown in Table 1 below.

Example 2

The operation of Example 1 was repeated in the same manner as in Example 1 except for changing the drawing ratios in Example 1 of 3.9 times (first drawframe), 10.0 times (second drawframe), 3.0 times (third drawframe) and 3.0 times (forth drawframe) to 4.1 times, 4.0 times, 2.0 times and 2.0 times, respectively; changing the number of Z (left) twist of 300 turns/m by the spinning frame to 183 turns/m; and changing the number of S (right) twist of 180 turns/m by the twister to 110 turns/m, whereby a spun yarn of 890 tex was obtained. The properties of the thus-obtained spun yarn are shown in Table 1 below.

Example 3

The operation of Example 1 was repeated in the same manner as in Example 1 except for changing the drawing ratios in Example 1 of 3.9 times (first drawframe), 10.0 times (second drawframe), 3.0 times (third drawframe) and 3.0 times (forth drawframe) to 4.0 times, 3.6 times, 2.0 times and 2.0 times, respectively; changing the number of Z (left) twist of 300 turns/m by the spinning frame to 180 turns/m; and then changing the twister operation from combining two of the spun yarns for doubling by a number of S (right) twist of 180 turns/m to combining three of the spun yarns for doubling by a number of S (right) twist of 100 turns/m, whereby a spun yarn of 1500 tex was obtained. The properties of the thus-obtained spun yarn are shown in Table 1 below.

TABLE 1

| | Carbon fiber mat | | | | Spun yarn | | | |
|---|---|---|---|---|---|---|---|---|
| Example | $\rho_L/\rho_W$ | Content of fibers of ≧ 100 mm (wt. %) | $M_{100}$ (N/tex) | $M_{200}/M_{100}$ | Content of fibers of ≧ 150 mm (wt. %) | Diameter (tex) | Number of primary twist (turns/m) | Strength (N/tex) |
| 1 | 0.03 | 80 | $3.9 \times 10^{-3}$ | 0.492 | 10 | 166 | 300 | 0.18 |
| 2 | | | | | 10 | 890 | 183 | 0.16 |
| 3 | | | | | 10 | 1500 | 180 | 0.15 |

INDUSTRIAL APPLICABILITY

As described above, according to the present invention, an (isotropic) pitch-based carbon fiber sliver can be efficiently produced through a simple process of providing a pitch-based carbon fiber mat comprising a mass of piled-up pitch-based carbon fibers of which fiber extension directions are aligned preferentially in one direction; and directly subjecting the carbon fiber mat to drawing and carding by means of a carding machine while moving the mat in said one preferential alignment direction. Further, a high-strength carbon fiber spun yarn can be obtained by spinning the carbon fiber sliver.

The invention claimed is:

1. A process for producing a pitch-based carbon fiber sliver, comprising: providing a pitch-based carbon fiber mat comprising a mass of piled-up pitch-based carbon fibers of which fiber extension directions are aligned preferentially in one direction; and directly subjecting the carbon fiber mat to drawing and carding by means of a carding machine while moving the mat in said one preferential alignment direction, wherein the pitch-based carbon fiber mat contains at least 30 wt. % of carbon fibers having a fiber length of at least 100 mm.

2. A production process according to claim 1, wherein the pitch-based carbon fiber mat has a resistance ($\rho_L$) in the preferential extension direction and a resistance ($\rho_W$) in a direction perpendicular to the preferential extension direction, providing a ratio $\rho_L/\rho_W$ of at most 0.25.

3. A production process according to claim 1, wherein the pitch-based carbon fiber mat contains at least 30 wt. % of carbon fibers having a fiber length of at least 100 mm and satisfies the following relations (1) and (2) with respect to $M_{100}$ (N/tex) representing a tensile strength for a test length of 100 mm and $M_{200}$ (N/tex) representing a tensile strength for a test length of 200 mm, respectively in the preferential extension directions of the piled carbon fibers.

$$1.7\times10^{-3} \leqq M_{100} \leqq 1.2\times10^{-2} \quad (1)$$

$$0.4 \leqq (M_{200}/M_{100}) \leqq 1 \quad (2)$$

4. A production process according to claim 1, wherein the pitch-based carbon fibers are isotropic pitch-based carbon fibers.

5. A production process according to claim 1, wherein the pitch-based carbon fiber mat has been obtained by melt-spinning a petroleum or coal pitch to form pitch fibers, piling the pitch fibers on a horizontal belt so as to extend preferentially in a direction of progress of the horizontal belt conveyer to form a pitch fiber mat, and then infusibilizing and calcining the pitch fiber mat.

6. A production process according to claim 5, wherein the pitch fiber has been obtained by melt-spinning the petroleum or coal pitch by means of a centrifugal spinning machine having a horizontal rotation axis.

7. A production process according to claim 1, wherein the carding machine is a large-width guile having a pair of front rollers including at least one roller surfaced with an elastic material.

8. A production process according to claim 1, further including a step of doubling and drawing the sliver after the carding by the large-width guile by a drawframe.

9. A process for producing a pitch-based carbon fiber spun yarn, comprising: drawing and twisting a pitch-based carbon fiber sliver by means of a spinning frame to produce a pitch-based carbon fiber spun yarn containing at least 3 wt. % of fibers having a fiber length of at least 150 mm, a number of primary twist of 50-400 turns/m, and a tensile strength of at least 0.10 N/tex, wherein the pitch-based carbon fiber sliver has been produced by the process of claim 1.

* * * * *

UNITED STATES PATENT AND TRADEMARK OFFICE

CERTIFICATE OF CORRECTION

PATENT NO. : 7,634,840 B2
APPLICATION NO. : 10/582866
DATED : December 22, 2009
INVENTOR(S) : Tatsuo Kobayashi et al.

It is certified that error appears in the above-identified patent and that said Letters Patent is hereby corrected as shown below:

Title page, Item (54) title and col. 1, line 5, change "SILVER" in the title to "SLIVER".

Signed and Sealed this

Twenty-third Day of March, 2010

David J. Kappos

David J. Kappos
*Director of the United States Patent and Trademark Office*